US006293473B1

(12) United States Patent
Ortwein et al.

(10) Patent No.: US 6,293,473 B1
(45) Date of Patent: Sep. 25, 2001

(54) RAILROAD SUBSTRUCTURE

(76) Inventors: Hermann Ortwein; Elisabeth Ortwein, both of Mühlenweg 25, D-51588 Nümbrecht (DE)

( * ) Notice: Subject to any disclaimer, the term of this patent is extended or adjusted under 35 U.S.C. 154(b) by 0 days.

(21) Appl. No.: 09/284,037

(22) PCT Filed: Sep. 30, 1997

(86) PCT No.: PCT/EP97/05371

§ 371 Date: Dec. 30, 1999

§ 102(e) Date: Dec. 30, 1999

(87) PCT Pub. No.: WO98/20203

PCT Pub. Date: May 14, 1998

(30) Foreign Application Priority Data

Nov. 8, 1996 (DE) ..... 196 46 133

(51) Int. Cl.[7] ..... E01B 26/00
(52) U.S. Cl. ..... 238/2; 238/8; 238/283
(58) Field of Search ..... 238/2, 6, 7, 8, 238/109, 264, 265, 282, 283, 292, 293, 306, 336, 382, 122

(56) References Cited

U.S. PATENT DOCUMENTS 947,108 * 1/1910 Lawrence ..... 238/8
3,417,922 * 12/1968 Dargier de Saint Vaulry ..... 238/292
3,469,783 * 9/1969 Uralli et al. ..... 238/8
3,955,761 * 5/1976 Szarka et al. ..... 238/8
4,775,103 * 10/1988 Ortwein ..... 238/283
5,165,598 * 11/1992 Ortwein ..... 238/283
5,535,947 * 7/1996 Hogue et al. ..... 238/2
5,622,312 * 4/1997 Martin ..... 238/2
5,655,711 * 8/1997 Hull et al. ..... 238/8

FOREIGN PATENT DOCUMENTS

4027836-A1 * 3/1992 (DE) .
4114803-A1 * 11/1992 (DE) .

* cited by examiner

*Primary Examiner*—Russell D. Stormer
*Assistant Examiner*—Lars A. Olson
(74) *Attorney, Agent, or Firm*—Herbert Dubno

(57) ABSTRACT

In an infrastructure for a railway track with continuous elastic support, the two rail (1) forming the track rest with their lateral limiting surfaces beneath the rail head, via elastic intermediate layers (3), against inner lateral limiting surfaces of a frame consisting of two frame halves (4, 5). The frame is located in a trough (6) embedded in a concrete plate (2) running longitudinally underneath the rails (1). Between a frame half (5) and a lateral wall (6R) of the trough (6) a wedge (7) is provided, pointing downwards with its narrower end and which can be tightened by screws (8). In this infrastructure next to the head of each rail (1)—on the inside of the track—an angle section (10) of steel is provided, the distance (A) between the head of the rail (1) and the upwards pointing lateral side of the angle section (10) corresponds approximately to the normal width of a grooved rail and the height (H) of the upwards pointing lateral side of the angle section (10) is selected so that this side does not project above the head of the rail (1).

10 Claims, 2 Drawing Sheets

RAILROAD SUBSTRUCTURE

CROSS REFERENCE TO RELATED APPLICATION

This application is a national stage of PCT/EP97/05371 filed Sep. 30, 1997 and based upon German national application 196 46 133.2 of Nov. 8, 1996 under the International Convention.

FIELD OF THE INVENTION

The invention relates to an infrastructure for railway tracks with continuous elastic support, whereby the two rails forming the track are supported, via elastic intermediate layers, with their lateral limiting surfaces underneath the rail head against the inner lateral surfaces of a frame consisting of two frame halves, located in a trough which is embedded in a concrete plate running longitudinally under the tracks, and whereby between the one frame half and a lateral wall of the trough a wedge pointing downwards with its narrower end and which can be secured by screws, is provided.

BACKGROUND OF THE INVENTION

As a rule tracks for rail vehicles are laid on beds, grit or compacted and optionally reinforced soil, on embankments of compacted material or on concrete plates, which lie directly on the ground (DE-OS 29 01 283, DE-OS 23 54 958). Such tracks are also frequently laid on gravel. The soil and a gravel bed or the like, are elastic within certain limits, thereby forming a spring cushion which provides a minor damping of the impact noise.

When in tracks laid out in the above manner elastically supported rails are used for further reduction of the vibrations resulting from the vehicle movements on the tracks and the related impact noise, the characteristic frequency of the elastic rail support acting as a spring interferes with the characteristic frequency of the second spring formed by the soil or gravel bed, such that the intended reduction of the impact noise is not achieved, or that shifts occur in the frequency ranges with possible increase in the noise.

Further an infrastructure is known wherein under each rail of the track a longitudinal sleeper is provided, consisting of a continuous rigid girder (DE-OS 40 27 836). Due to this construction of the infrastructure, the latter has such a high bending moment that no bending or only a negligible bending of the infrastructure can take place and the spring effect of the support layer is cancelled out.

In order to avoid the aforedescribed disadvantages, a further known infrastructure is designed so that each rail of the track with the pertaining frame halves is embedded in a trough, whereby one frame half rests directly against the one lateral trough wall, and the other frame half rests against the other trough wall via a wedge (DE 44 27 237 A1). This infrastructure has proven to be very advantageous. However it can not be used everywhere.

OBJECTS OF THE INVENTION

It is the object of the invention to further improve the mentioned infrastructure.

SUMMARY OF THE INVENTION

This object is achieved in that an angle section made of steel is provided next to the head of each rail on the inside of the rail.

According to the invention the distance between the rail head and the upwardly pointing side of the angle section corresponds approximately to the width of a grooved rail. The height of the upwardly pointing side of the angle section is selected so that this side does not project above the rail head.

This construction of the infrastructure of the invention makes possible the use thereof also in such tracks which normally consist of grooved rails.

In an embodiment of the invention, the lateral sides of the angle section are not equal and its longer side rests on the respective frame half and/or the wedge and is fastened by screws which pass through bores provided in the lateral side. As a result the angle section is securely connected with the infrastructure.

In a further embodiment of the invention, the screws serving for the fastening of the angle section are the same screws used for the tightening of the wedge. Therefore only few screws are required.

In order to be able to adjust the width of the grooves, i.e. the distance between the rail head and the angle section to he requirements, for instance in curves, the bores provided in he longer lateral side of the angle section are designed as elongated holes running transversely to the rail.

In a particularly advantageous embodiment of the infrastructure of the invention, a further angle section is provided on the outer side of the track next to each rail, whose upwards pointing lateral side has a height which corresponds approximately to the height of the upwards pointing lateral side of the steel angle section, and between the rail head and the further angle section a packing of elastic material is provided.

An infrastructure of the same design can also be used for roads used by other vehicles, because the spaces next to the angle sections can be filled with asphalt, bitumen, pavement or the like.

Suitably the further angle section is made of a plastic material. A corresponding angle section can be produced at very low cost.

According to another feature of the invention, that frame half on the outer side of the track can be provided with an upwards pointing projection, whose height corresponds approximately to the height of the upwards pointing lateral side of the steel angle section, and between the rail head and the upwards pointing projection of the frame half there is a packing of elastic material. The upwards pointing projection of the frame half serves the same purpose as the further angle section in the previously described embodiments of the infrastructure of the invention.

Since the packing of elastic material does not have to transmit any forces, it is possible to save material by designing the packing with at least one hollow space running in the longitudinal direction of the rails.

A simplified production of the packing of elastic material is achieved in that the packing is made in one piece with those elastic intermediate layers on the same side of the rail.

In order to insure in the aforementioned embodiment of the infrastructure that the elastic intermediate layers and the lower area of the packing have as much as possible the same elasticity, one of the hollow spaces provided in the elastic intermediate layers extends into the lower area of the packing.

In a further development of the invention, the two frame halves and wedge are made of finished plastic components, preferably glass-fiber reinforced plastic material, whereby the finished components consist of hollow bodies. Such finished components are easy to manufacture and have a relatively reduced weight.

A further weight reduction of the aforementioned finished components is achieved in that both frame halves and the wedge consist of hollow components open to one side, which are reinforced by transversely running ribs.

The infrastructure of the invention can also be further improved by producing the trough, the two frame halves and the wedge from the same plastic material, These parts can for instance be made of recycled plastic material. Therefore the production of these parts is particularly simple and cost-effective.

In order to achieve a secure connection of the individual segments of the trough and the two frame halves, at interfaces of the trough and of the two frame halves their wall thickness is reduced to the extent that the bordering wall portions overlap.

In order to be able to lay out the infrastructure of the invention at curves without problems, the overlapping wall portions are selected so that a gap remains between the overlapping wall portions, whereby the overlapping wall portions narrow down outwardly, so that the gap between the overlapping wall portions runs obliquely.

The trough and the two frame halves are secured against displacement by providing them with projections and corresponding recesses, which interengage in the assembled state.

BRIEF DESCRIPTION OF THE DRAWING

The infrastructure of the invention is further explained with the aid of the drawing, wherein two embodiments are schematically represented. In the drawing.

SPECIFIC DESCRIPTION

Figure 1:
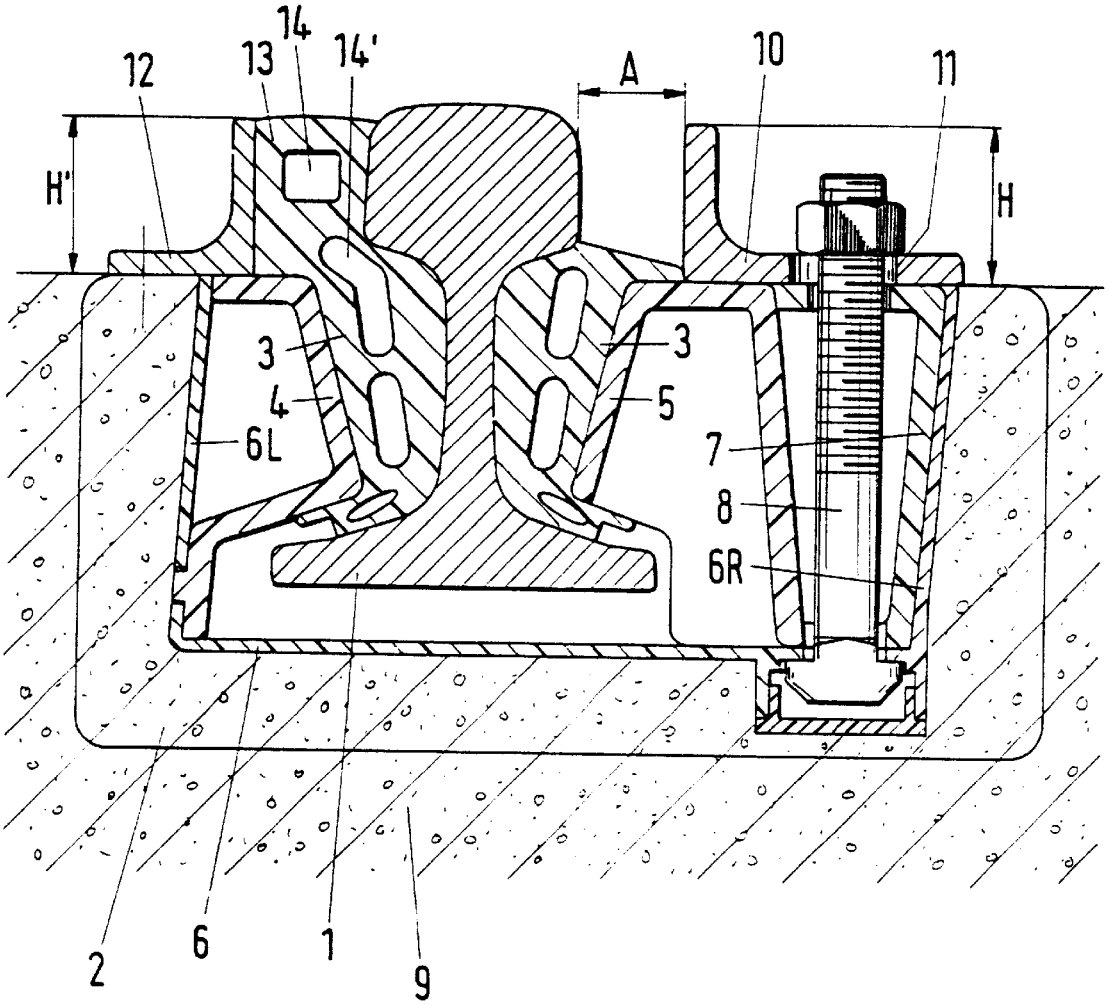
FIG. 1 is a cross sectional view of an infrastructure for a railway track at one of rails forming the track.

The infrastructure shown in FIG. 1 has a rail 1 and a plate 2 made of concrete. The rail 1 is supported via an elastic intermediate layer 3 against the inner lateral limiting surface of a frame formed by two frame halves 4 and 5. The frame half 4 in turn rests against a first lateral wall 6L of a trough 6, while the other frame half 5 rests against the second lateral wall 6R of the trough, via a wedge 7 which has been tightened by means of a screw 8. Hollow spaces 16, 17 and 18 are provided in the frame members 4 and 5 and in the wedge 7.

The plate 2 consists of site-mixed concrete which has been poured into the space between the trough 6 and the foundation 9. After the alignment of rail 1, the subsequent mounting of the trough 6, of the elastic intermediate layer 3, of the two frame halves 4 and 5 as well as of the wedge 7 are effected.

Next to the head of rail 1—on the inside of the track —an angle section 10 made of steel is arranged, whose upwardly directed pointing lateral side is at a distance A from the head of the rail 1. The height H of the upwards pointing lateral side of the angle section 10 is selected so that the lateral side does not project over the head of rail 1. The longer lateral side or flanges of the angle section 10 designed with lateral sides or flanges of unequal width rests on the frame half 5 and the wedge 7. The bores 11 provided in the angle section 10 for the passage of screws 8 are elongated holes running transversely with respect to the rail 1.

On the outside of the track, next to each rail 1, a further angle section 12 is provided. The height H' of the upwardly directed lateral side of this angle section 12 corresponds approximately to the height H of the angle sections 10. Between the head of rail 1 and the further angle section 12, there is a packing 13 made of an elastic material, which is made in one piece with the elastic intermediate layers 3 located underneath. The packing has a hollow space 14 running in the longitudinal direction of the rails. One of the hollow spaces 14' provided in the elastic intermediate layers 3 extends into the lower area of the packing 13.

Figure 2:
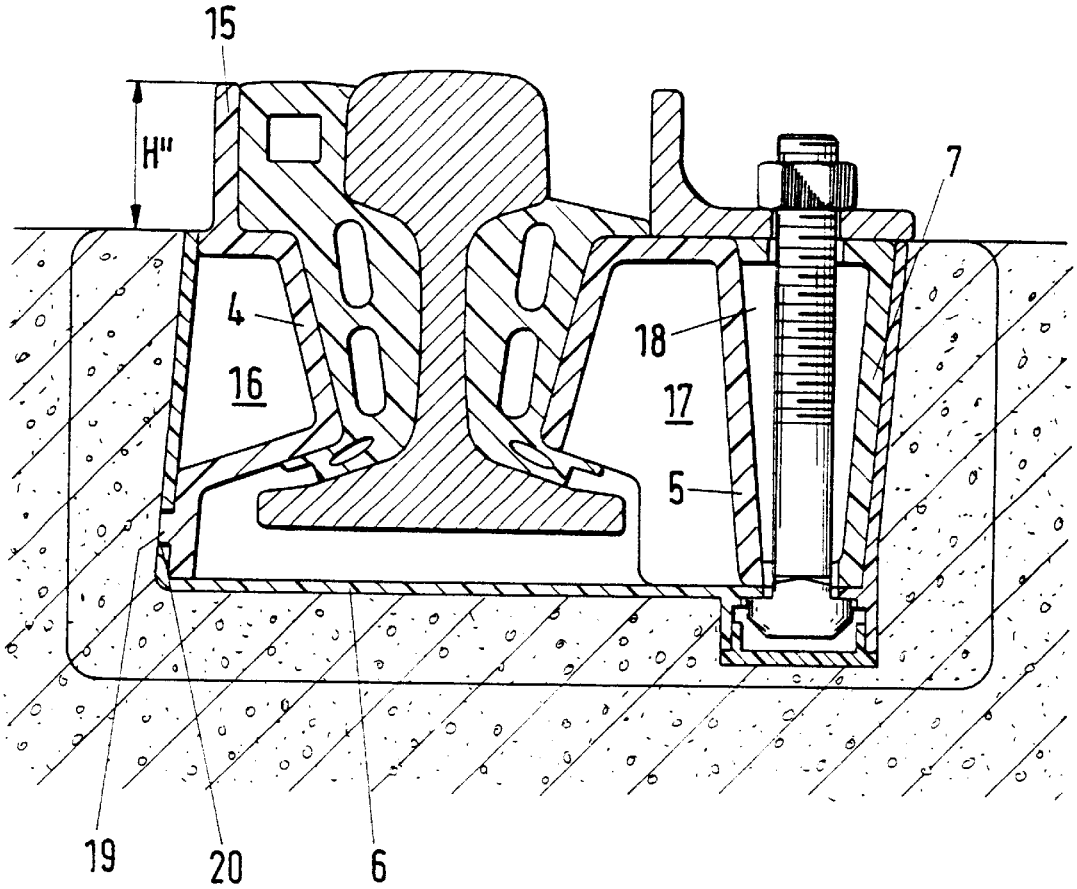
FIG. 2 is a similar view of another infrastructure for a railway track.

In the infrastructure shown in FIG. 2, the frame half 4 on the outside of the track is provided with an upwardly directed projection 15. The height H" of the upwardly directed projection 15 corresponds approximately to the height H of the angle section 10.

The two frame halves 4 and 5 are arranged immovably against the trough 6. For this purpose projections 19 and corresponding recesses 20 are provided, which interengage in the assembled state. In the represented embodiment example there is a projection 19 on the frame part 4, while the trough is provided with a recess 20. But it is also possible to provide projections on the trough and recesses on the frame parts.

Figure 3:
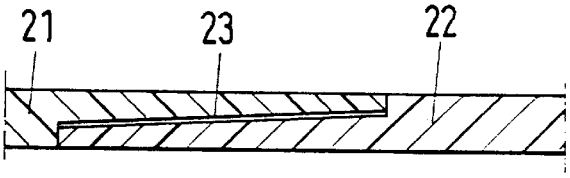
FIG. 3 is a longitudinal section through the adjacent wall portions of a trough of the infrastructure.

As can be seen from FIG. 3, the wall thickness of the adjacent wall portions 21 and 22 of the trough and of the two frame halves are reduced at their interface in such a manner that the wall portions 21 and 22 overlap. Thereby the wall thickness of the overlapping areas of the wall portions 21 and 22 are selected so that a gap 23 remains.

What is claimed is:

1. A rail and support structure comprising:

a rail adapted to form part of a railway track and having a head;

a concrete plate extending longitudinally along said rail and in which a trough is embedded receiving said rail, said trough having a pair of opposite sides spaced from sides of said rail, said plate having an upper surface below said head;

respective frame halves in said trough on an inner side of said rail and an outer side of said rail, extending over a base of said rail and bearing by respective elastic layers upon opposite sides of said rail, each of said frame halves being disposed between one of said sides of said rail and a respective one of said sides of said trough;

a downwardly tapering wedge braced between one of said sides of one of said frame halves and the respective side of said trough; and a steel angle section on the frame half on said inner side of said rail and having an upwardly directed flange spaced horizontally from said head and disposed alongside said head and a horizontally directed flange extending along said surface and secured to said concrete plate, said flanges lying at a right angle to one another, said upwardly directed flange having an upper edge lying below a top of said head.

2. The rail and support structure defined in claim 1 wherein said flanges are of unequal length, horizontally directed flange being longer than said upwardly directed flange, said steel angle section being secured to said concrete plate by a screw passing through said horizontally directed flange and through said wedge for tightening said wedge, said horizontally directed flange having an elongated hole running transversely to said rail for receiving said screw.

3. The rail and support structure defined in claim 1 further comprising another angle section connected to said plate and having an upwardly extending flange of a height corresponding approximately to the height of said upwardly directed flange of the first mentioned steel angle section, and a packing of elastic material between said further angle section and said head of the rail.

4. The rail and support structure as defined in claim 3 wherein said other angle section is made of plastic material.

5. The rail and support structure as defined in claim 1 wherein said frame half on said outer side of said rail has an upwardly directed extension laterally spaced from said head and a packing of elastic material between said extension and said head.

6. The rail and support structure as defined in claim 1 wherein the elastic layer between said frame half on said outer side of said rail and said outer side of said rail extends upwardly into a packing along side said head, said packing having a hollow space running in a longitudinal direction of the rail.

7. The rail and support structure as defined in claim 6 wherein said packing is formed in one piece with said elastic layer between said frame half on the outer side of said rail.

8. The rail and support structure as defined in claim 7 wherein a hollow space is formed in said packing and the elastic layer in one piece therewith.

9. The rail and support structure as defined in claim 1 wherein said frame halves and said wedge are formed from glass fiber reinforced plastic hollow bodies.

10. The rail and support structure as defined in claim 9 wherein said hollow bodies are open to one side and are reinforced by transversely running ribs.

* * * * *